US009738479B2

(12) United States Patent
Iwasawa et al.

(10) Patent No.: US 9,738,479 B2
(45) Date of Patent: Aug. 22, 2017

(54) IMAGE FORMING APPARATUS

(71) Applicant: CANON KABUSHIKI KAISHA, Tokyo (JP)

(72) Inventors: Ryo Iwasawa, Kawasaki (JP); Daisuke Yamamoto, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/497,163

(22) Filed: Sep. 25, 2014

(65) Prior Publication Data

US 2015/0091239 A1 Apr. 2, 2015

(30) Foreign Application Priority Data

Sep. 30, 2013 (JP) ..... 2013-205133

(51) Int. Cl.

| | |
|---|---|
| ***B65H 29/00*** | (2006.01) |
| ***B65H 29/14*** | (2006.01) |
| ***B65H 29/58*** | (2006.01) |
| ***B65H 85/00*** | (2006.01) |
| ***G03G 15/23*** | (2006.01) |
| ***G03G 15/00*** | (2006.01) |

(52) U.S. Cl.

CPC ..... *B65H 29/14* (2013.01); *B65H 29/58* (2013.01); *B65H 85/00* (2013.01); *G03G 15/234* (2013.01); *G03G 15/6552* (2013.01); *B65H 2301/33312* (2013.01); *B65H 2301/4212* (2013.01); *B65H 2404/632* (2013.01); *B65H 2404/725* (2013.01); *B65H 2405/1134* (2013.01); *G03G 2215/00675* (2013.01)

(58) Field of Classification Search

CPC ..... B65H 15/00; B65H 15/02; B65H 29/14; B65H 29/58; B65H 2301/33312; B65H 2301/4212; B65H 2404/632

USPC ..... 271/65, 184–186, 225, 902, 303, 220

See application file for complete search history.

(56) References Cited

U.S. PATENT DOCUMENTS

| | | | | |
|---|---|---|---|---|
| 7,533,882 | B2 * | 5/2009 | Song | 271/186 |
| 7,637,497 | B2 * | 12/2009 | Kusama | 271/186 |

(Continued)

FOREIGN PATENT DOCUMENTS

| | | | |
|---|---|---|---|
| CN | 101521716 | A | 9/2009 |
| JP | 2000-026002 | A | 1/2000 |

(Continued)

*Primary Examiner* — Thomas Morrison

(74) *Attorney, Agent, or Firm* — Canon U.S.A., Inc. IP Division

(57) ABSTRACT

An image forming apparatus includes an image forming unit configured to form an image on a sheet, a stacking portion on which the sheet having the image formed thereon is to be stacked, a first roller capable of forward and reverse rotations, a second roller capable of rotating with the first roller when the first roller makes a forward rotation, a third roller capable of rotating with the first roller when the first roller makes a reverse rotation and then the forward rotation, a regulation portion movable between a regulation position where entering of the sheet into a nip portion between the first and second rollers is prevented, and an allowing position where discharge of the sheet is allowed, and a movement unit configured to cause the regulation portion to be placed in the allowing position during forward rotation, and to be placed in the regulation position during reverse rotation.

16 Claims, 12 Drawing Sheets

(56) References Cited

U.S. PATENT DOCUMENTS

| | | | | |
|---|---|---|---|---|
| 7,762,552 | B2 * | 7/2010 | Guerand et al. | 271/303 |
| 7,764,920 | B2 * | 7/2010 | Lin et al. | 399/374 |
| 7,918,451 | B2 * | 4/2011 | Honda et al. | 271/225 |
| 7,938,390 | B2 * | 5/2011 | Shingai | B65H 31/02 271/207 |
| 2004/0052563 | A1 | 3/2004 | Hayamizu | |
| 2007/0020007 | A1 * | 1/2007 | Azuma | 399/367 |
| 2008/0085141 | A1 | 4/2008 | Lin | |
| 2008/0284090 | A1 | 11/2008 | Honda | |
| 2009/0108517 | A1 | 4/2009 | Guerand | |

FOREIGN PATENT DOCUMENTS

| | | | |
|---|---|---|---|
| JP | 2004-099293 | A | 4/2004 |
| JP | 2008-044785 | A | 2/2008 |
| JP | 2008-285279 | A | 11/2008 |
| JP | 2009173441 | A | 8/2009 |
| JP | 2010-143696 | A | 7/2010 |
| JP | 2012-140200 | A | 7/2012 |

* cited by examiner

IMAGE FORMING APPARATUS

BACKGROUND OF THE INVENTION

Field of the Invention

The present invention relates to an image forming apparatus such as a copying machine, a printer, a multifunction peripheral having a copy function and a print function, and a facsimile. In particular, the present invention relates to an image forming apparatus having a function of reversely conveying a sheet to form images on both sides of the sheet while the sheet is conveyed.

Description of the Related Art

A conventional image forming apparatus such as a copying machine, a printer, a multifunction peripheral having a copy function and a print function, and a facsimile is provided with a function of printing on both sides of a sheet. Two-sided printing is generally performed by a two-sided discharge mechanism near a discharge tray.

In the case of one-sided printing, a sheet on which printing has been completed is discharged onto a discharge tray by a discharge roller pair and is stacked thereon. In the case of two-sided printing, a sheet on which printing has been completed on a first side is switched back by a reverse roller pair, fed again to a two-sided printing conveyance path, and then conveyed to a printing process for a second side thereof.

The above operations are performed by a drive mechanism which causes each of the conveyance roller pairs to rotate normally (forward) or reversely, and a switching mechanism which switches a conveyance path by using a flipper. To simplify the apparatus, which has been required in recent years, it is important to cause the mechanisms to operate in conjunction with each other and to achieve a reduction in the number of components of the entire apparatus.

Japanese Patent Application Laid-Open No. 2000-26002 discusses a configuration for performing a sheet discharge operation and a sheet reversal operation by one driving roller and two driven rollers (hereinafter referred to as triple rollers as appropriate). Japanese Patent Application Laid-Open No. 2012-140200 discusses a configuration for performing a sheet discharge operation and a sheet reversal operation by one conveyance roller pair.

However, in the configuration discussed in Japanese Patent Application Laid-Open No. 2000-26002, when the reversal operation is performed by the conveyance roller pair, a sheet on a discharge tray provided near the conveyance roller pair may be entangled therein, causing the sheet to move backward, resulting in conveyance failure.

FIG. 1 is a schematic sectional view of a configuration of a conventional two-sided discharge mechanism 10 based on Japanese Patent Application Laid-Open No. 2000-26002. As illustrated in FIG. 1, the conventional two-sided discharge mechanism 10 includes triple rollers 11 for performing a discharge operation and a reversal operation, and a conveyance guide 12 inside the apparatus. In FIG. 1, a sheet 13 discharged by the two-sided discharge mechanism 10 cannot be completely stacked on a discharge tray 14 and remains near the conveyance roller pair.

When the reversal operation is performed in this state, the conveyance roller pair rotates in a direction indicated by solid line arrows illustrated in FIG. 1, which is opposite to a direction of when the discharge operation is performed. At this time, the sheet 13 receives a conveyance force from the conveyance roller pair, and is conveyed in a direction indicated by a dash-dot line illustrated in FIG. 1. As a result, the sheet 13 moves backward to the conveyance path inside the image forming apparatus. Occurrence of such a backward movement may cause a phenomenon in which the sheet 13 gets caught by a step portion 15 of the conveyance guide 12 through a path indicated by a dotted line arrow illustrated in the conveyance path, or may cause a sheet-passing failure due to interference with a subsequent sheet (not illustrated) in the conveyance path during continuous printing.

In the configuration discussed in Japanese Patent Application Laid-Open No. 2000-26002, there is no member having a function of preventing the sheet 13 from moving backward, near the triple rollers 11. Therefore, part of stacked sheets may come into contact with the conveyance roller pair, causing the above phenomenon to occur.

According to Japanese Patent Application Laid-Open No. 2012-140200, there is provided a regulation member protruding into the discharge tray area, thereby preventing a stacked sheet from moving backward. However, Japanese Patent Application Laid-Open No. 2012-140200 does not discuss the prevention of a stacked sheet from moving backward when triple rollers are used. Further, in the configuration discussed in Japanese Patent Application Laid-Open No. 2012-140200, the regulation member is located much below the nip portion between the discharge roller pair. Thus, in a case where a sheet cannot be completely discharged and is in contact with the discharge roller pair as illustrated in FIG. 1, the effect of the regulation member cannot be attained, and there exists an area where the backward movement cannot be prevented.

SUMMARY OF THE INVENTION

The present invention is directed to an image forming apparatus using triple rollers which is configured to prevent a stacked sheet from moving backward when performing a reversal operation to form images on both sides of a sheet.

According to an aspect of the present invention, an image forming apparatus includes an image forming unit configured to form an image on a sheet, a stacking portion on which the sheet having the image formed thereon by the image forming unit is to be stacked, a first roller configured to be capable of forward rotation and reverse rotation, a second roller which has a rotation center disposed below a rotation center of the first roller in a vertical direction in normal operation, and which is configured to rotate with the first roller when the first roller makes a forward rotation when the sheet is to be discharged onto the stacking portion, a third roller which has a rotation center disposed above the rotation center of the first roller in the vertical direction in normal operation, and which is configured to rotate with the first roller when the first roller makes a reverse rotation and then the forward rotation when a sheet having an image formed on a first side thereof by the image forming unit is to be conveyed to the image forming unit to form an image on a second side thereof opposite to the first side, a regulation portion provided so as to be movable between a regulation position where entering of the sheet stacked on the stacking portion into a nip portion between the first roller and the second roller is prevented, and an allowing position where discharge of the sheet by the first roller and the second roller is allowed, and a movement unit configured to cause the regulation portion to be placed in the allowing position while the first roller performs a forward rotation, and to cause the regulation portion to be placed in the regulation position while the first roller performs a reverse rotation.

Further features of the present invention will become apparent from the following description of exemplary embodiments with reference to the attached drawings.

DESCRIPTION OF THE EMBODIMENTS

Various exemplary embodiments, features, and aspects of the invention will be described in detail below with reference to the drawings. Each of the embodiments of the present invention described below can be implemented solely or as a combination of a plurality of the embodiments or features thereof where necessary or where the combination of elements or features from individual embodiments in a single embodiment is beneficial.

A first exemplary embodiment of the present invention will be described below using a case where the first exemplary embodiment is applied to a laser beam printer as an example of the image forming apparatus. First, a configuration of an image forming apparatus 100 serving as a laser beam printer and an image forming process will be described with reference to FIG. 2.

Figure 1:
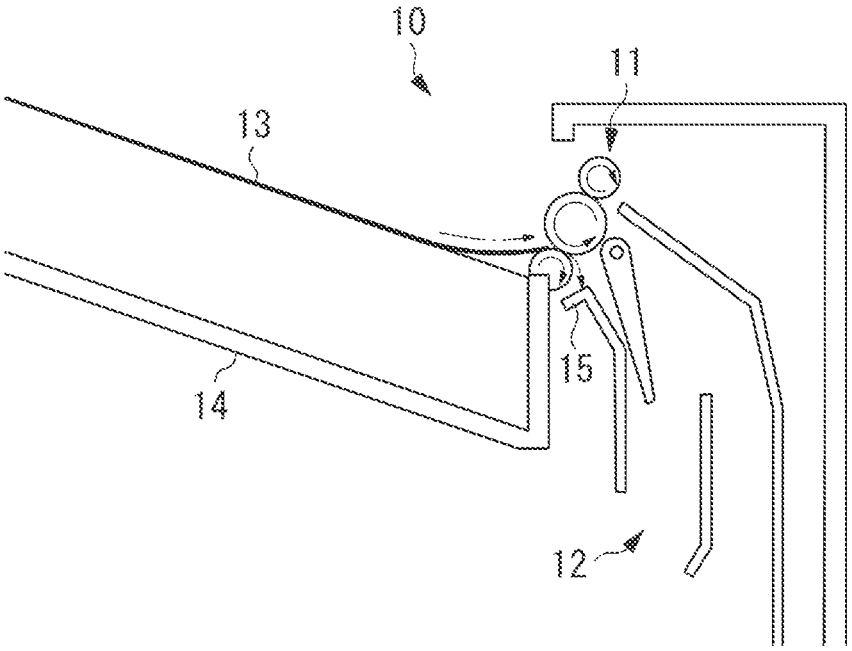
FIG. 1 is a schematic sectional view of a configuration of a conventional two-sided discharge device.
Figure 2:
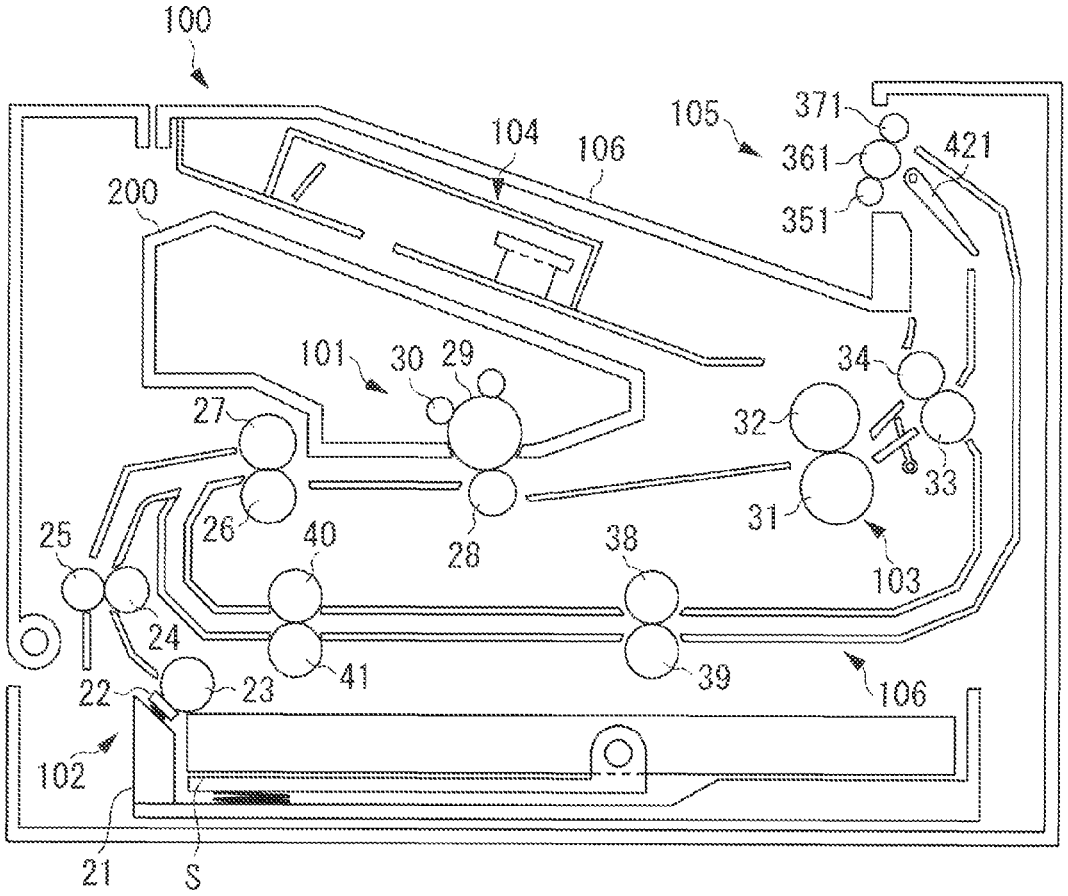
FIG. 2 is a schematic sectional view of an image forming apparatus according to a first exemplary embodiment.

FIG. 2 is a schematic sectional view of the image forming apparatus 100. As illustrated in FIG. 2, the image forming apparatus 100 includes an image forming unit 101, a feeding device 102, a laser scanner unit 104, a fixing device 103, a two-sided discharge device 105, and a discharge tray (stacking portion) 106.

The feeding device 102 includes a feeding cassette 21, a separation pad 22, and a feeding roller 23, and feeds a stacked sheet S by using the feeding roller 23. Then, the sheet S is further conveyed to a downstream side by a feeding conveyance roller pair formed by feeding conveyance rollers 24 and 25 provided on a downstream side in a conveyance direction. The feeding device 102 also includes a registration roller pair formed by registration rollers 26 and 27 for temporarily stopping the sheet S to perform registration between a toner image and the sheet S. For the sheet S conveyed by the feeding conveyance roller pair, positioning and conveyance timing adjustment are performed by the registration roller pair. Then, the sheet S is conveyed to the image forming unit 101.

The image forming unit 101 includes a process cartridge 200 detachably attached to the main body of the image forming apparatus 100, and the process cartridge 200 includes a photosensitive drum 29 serving as an image bearing member. Further, the image forming unit 101 includes a transfer roller 28 opposing the photosensitive drum 29. Based on image information along with a print command, laser light is applied from the laser scanner unit 104 to a surface of the photosensitive drum 29 which is uniformly charged by a charging device, whereby an electrostatic latent image is formed on the surface of the photosensitive drum 29. By developing the electrostatic latent image using a developing device 30, a toner image is formed on the surface of the photosensitive drum 29. The toner image formed on the surface of the photosensitive drum 29 is transferred to the sheet S that has been fed into a nip portion between the photosensitive drum 29 and the transfer roller 28 by the registration roller pair. The sheet S to which the image has been transferred is conveyed to the fixing device 103.

The fixing device 103 includes a heating roller 32, a pressure roller 31 in press contact with the heating roller 32, and fixing conveyance rollers 33 and 34. The sheet S conveyed to the fixing device 103 is guided into a nip portion between the heating roller 32 of the fixing device 103 and the pressure roller 31 in press contact with the heating roller 32. At this time, the toner image is heated and pressurized to be fixed to the sheet S. Then, the sheet S is carried by the fixing conveyance roller pair formed by the fixing conveyance rollers 33 and 34, and is conveyed to the two-sided discharge device 105.

The two-sided discharge device 105 includes triple rollers having a sheet discharge function and a sheet reversal function, and a flipper (switching portion) 421 for switching a conveyance path. The two-sided discharge device 105 selects the discharge operation or the reversal operation according to the print command. In the case of the discharge operation, the sheet S is directly discharged onto the discharge tray 106 and stacked thereon. In the case of the reversal operation, a conveyance direction of the sheet S is reversed with a predetermined timing to feed the sheet S to a reversing conveyance path. Then, the sheet S is fed again by a two-sided conveyance roller pair formed by two-sided conveyance rollers 38 and 39, and a re-feed roller pair formed by re-feed rollers 40 and 41. The re-fed sheet S passes the image forming unit 101 and the fixing device 103 again, whereby printing is performed on a second side of the sheet S in a similar way to a first side thereof. The sheet S on which printing has been performed on a second side is discharged onto the discharge tray 106 by the two-sided discharge device 105, and is stacked thereon.

Next, a configuration of the two-sided discharge device 105 will be described in detail with reference to FIGS. 3A, 3B, and 4. A support portion of each component and a conveyance guide unnecessary to describe the two-sided discharge device 105 and therefore are omitted in FIGS. 3A, 3B, and 4.

Figure 3A:
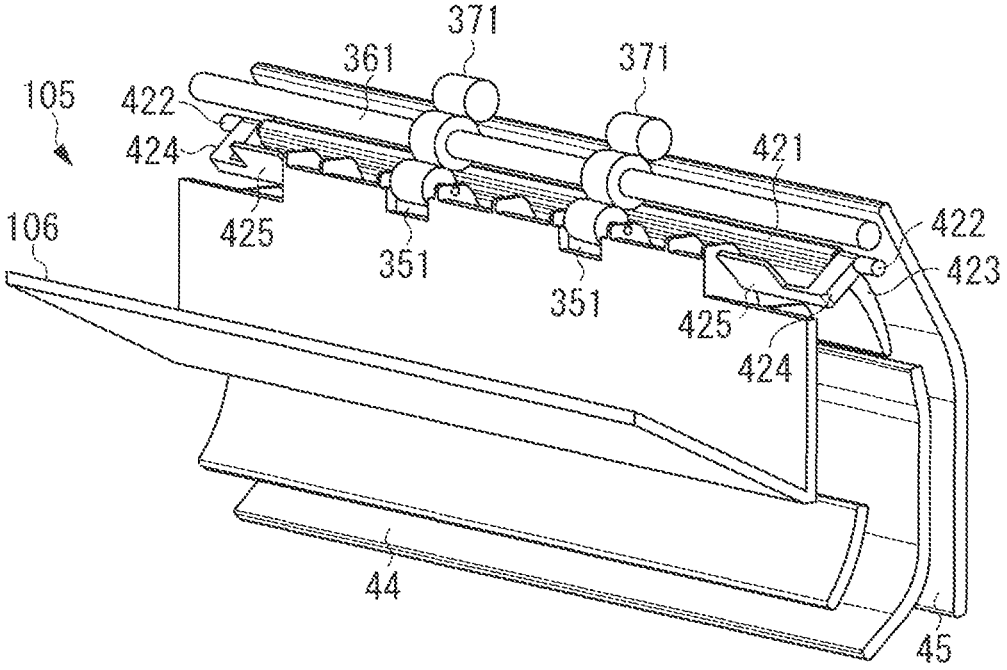
FIG. 3A is a schematic perspective view of a two-sided discharge device according to the first exemplary embodiment.

FIG. 3A is a schematic perspective view of the two-sided discharge device 105. As illustrated in FIG. 3A, the two-sided discharge device 105 includes triple rollers consisting of a discharge driving roller (first roller) 361, discharge driven rollers (second rollers) 351, and reversal driven rollers (third rollers) 371, and a flipper 421.

Figure 11:
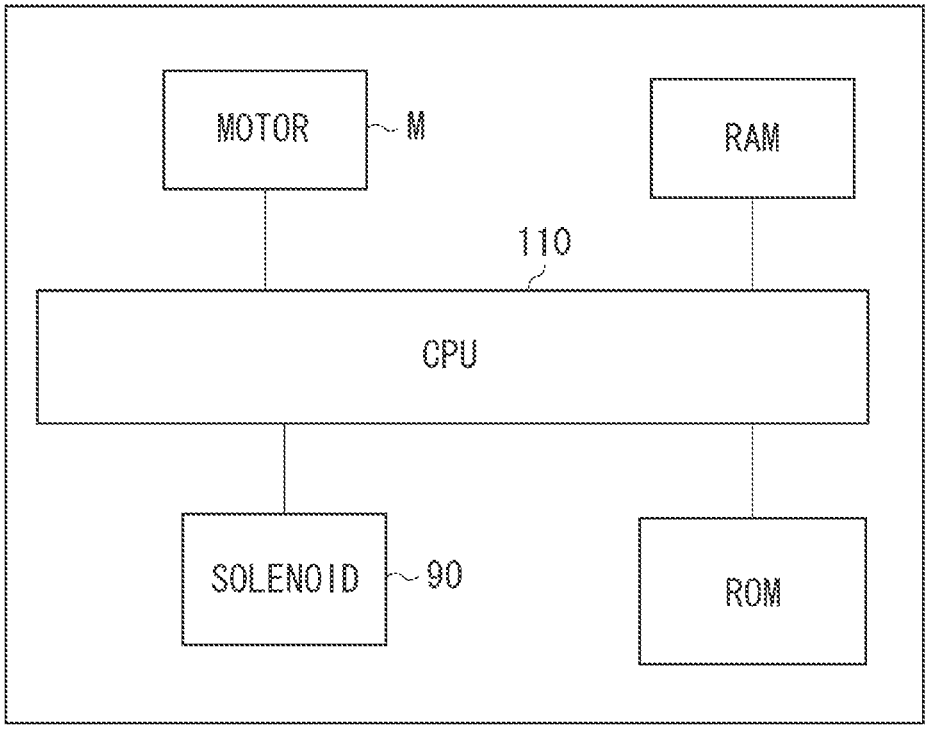
FIG. 11 is a block diagram of a control unit according to the first exemplary embodiment.

The discharge driving roller 361 rotates upon receiving a drive force from a motor M (drive source) which generates a drive force, and the rotational direction thereof (normal or reverse) is determined according to switching of a drive train by a solenoid 90. FIG. 11 is a block diagram of a control unit according to the first exemplary embodiment. As illustrated in FIG. 11, a central processing unit (CPU) 110 is connected to the motor M and the solenoid 90. Further, the CPU 110 is connected to a read-only memory (ROM) and a random-access memory (RAM). By using the RAM as a work memory, the CPU 110 executes a program stored in the ROM. In the first exemplary embodiment, the CPU 110, the ROM, and the RAM constitute a control unit. The control unit controls the solenoid 90 to switch the drive train that transmits the drive force from the motor M to the discharge driving roller 361.

The discharge driven roller 351 is provided below the discharge driving roller 361, and is in press contact with the discharge driving roller 361. The discharge driven roller 351 and the discharge driving roller 361 form a nip portion, and the discharge driven roller 351 rotates following the rotating discharge driving roller 361. The discharge driven roller 351 rotates following the discharge driving roller 361 making normal rotation when discharging the sheet S onto the discharge tray 106.

The reversal driven roller 371 is provided above the discharge driving roller 361, and is in press contact with the discharge driving roller 361. The reversal driven roller 371 and the discharge driving roller 361 form a nip portion, and the reversal driven roller 371 rotates following the rotating discharge driving roller 361. The reversal driven roller 371 rotates following the discharge driving roller 361 which makes the reverse rotation and then the normal rotation when the sheet S is to be conveyed to the image forming unit 101 again.

The flipper 421 is formed by rotation centers 422, a conveyance guide portion 423, connection portions 424, and backward movement prevention portions (regulation portions) 425. The flipper 421 is supported so as to be rotatable around the rotation center 422, and is connected to a part of the rotation center 422 and the drive train for the above-mentioned discharge driving roller 361. Thus, the flipper 421 rotates in response to receiving a rotational drive force from the motor M when the solenoid 90 switches the drive train. At this time, the rotational direction of the flipper 421 is determined according to the switching of the solenoid 90, similarly to the rotational direction (normal or reverse) of the discharge driving roller 361.

The configuration according to the first exemplary embodiment is such that when the discharge driving roller 361 rotates clockwise, the flipper 421 also rotates clockwise (makes normal rotation), and when the discharge driving roller 361 rotates counterclockwise, the flipper 421 also rotates counterclockwise (makes reverse rotation). That is, the discharge driving roller 361 and the flipper 421 operate in conjunction with each other to rotate in the same direction.

When the flipper 421 rotates, a contact portion of the flipper 421 comes into contact a part of a member of the image forming apparatus 100, and the flipper 421 is locked at a predetermined position. Thus, the flipper 421 has two lock positions determined by the normal rotation direction and reverse rotation direction of the discharge driving roller 361. Further, the conveyance guide portion 423 and the backward movement prevention portion 425 of the flipper 421 are connected to each other via the connection portion 424.

Figure 3B:
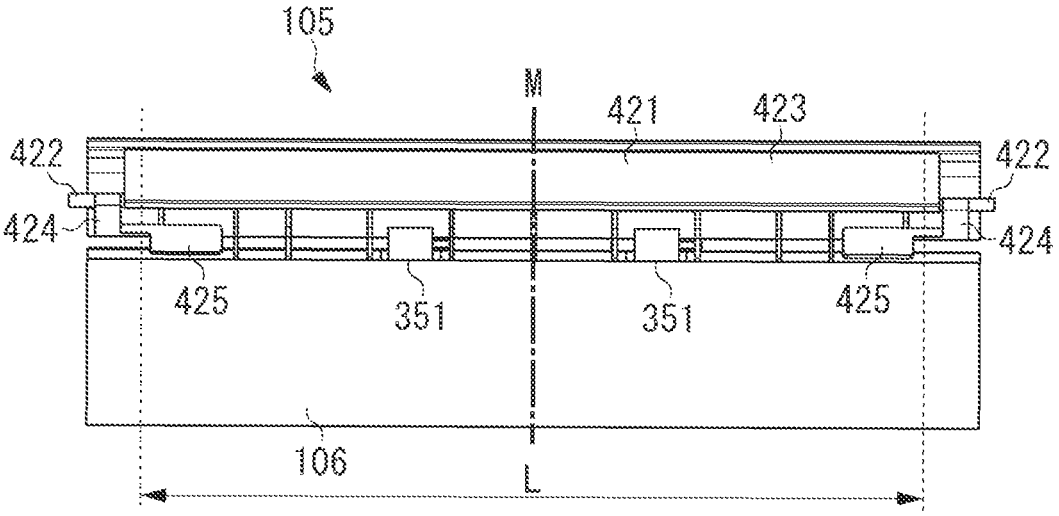
FIG. 3B is a schematic top view of the two-sided discharge device according to the first exemplary embodiment.

FIG. 3B is a schematic top view of the two-sided discharge device 105. Similarly to FIG. 3A, the conveyance guide and rollers unnecessary for the description are omitted in FIG. 3B. As illustrated in FIG. 3B, the flipper 421 is arranged symmetrically with respect to a center M of a conveyance area L of the sheet S. The connection portion 424 is formed at both right and left ends of the flipper 421 and outside the conveyance area L in a longitudinal direction (sheet width direction orthogonal to the conveyance direction) of the maximum size sheet among the sheets that can be conveyed by the image forming apparatus 100. This is to prevent the sheet S being conveyed from coming into contact with the connection portion 424 in any position that the flipper 421 can take. The backward movement prevention portion 425 is arranged at both the right and left ends of the flipper 421, and is arranged inside the conveyance area L in the longitudinal direction.

Figure 4:
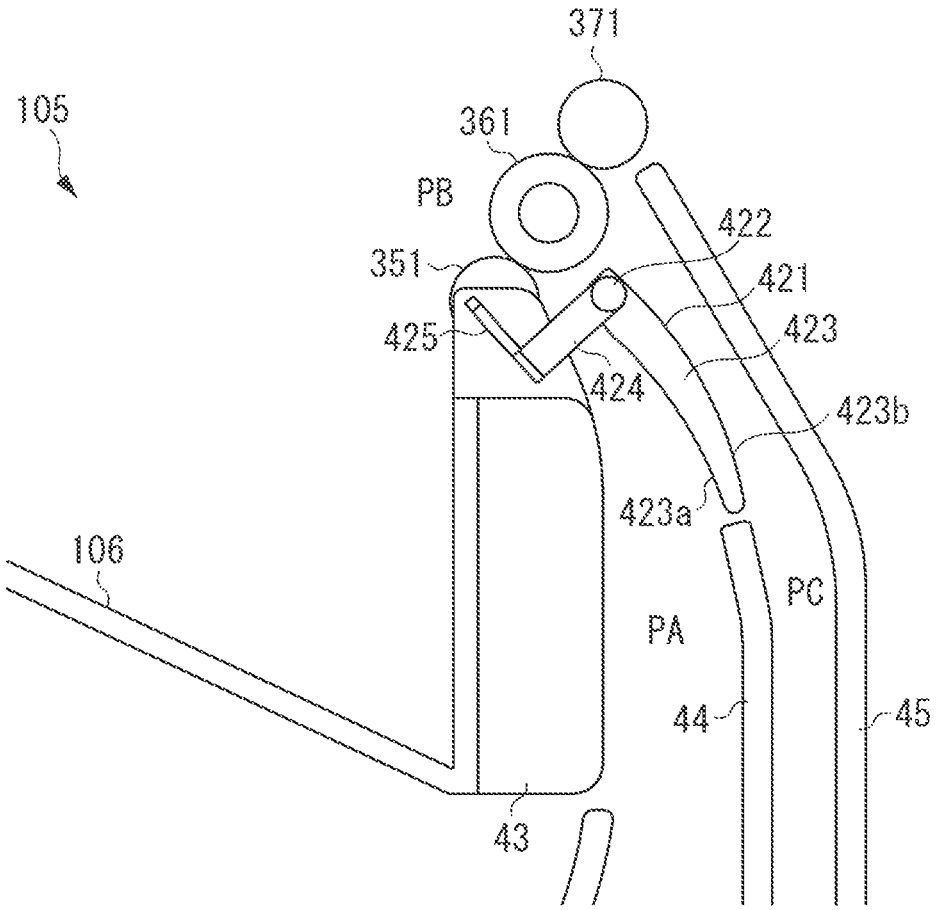
FIG. 4 is a schematic sectional view of the two-sided discharge device according to the first exemplary embodiment.

FIG. 4 is a schematic sectional view of the two-sided discharge device 105. As illustrated in FIG. 4, the two-sided discharge device 105 has three conveyance areas PA, PB, and PC. The conveyance area PA is formed by an inner conveyance guide 43, a conveyance guide surface 423*a* of the flipper 421, and a middle conveyance guide 44. Mainly, the sheet S on which the discharge operation is performed passes the conveyance area PA. The conveyance area PB is a conveyance area on a downstream side of the triple rollers. The sheet S on which the discharge operation and the reversal operation are performed passes in the conveyance area PB. The conveyance area PC is formed by the middle conveyance guide 44, the conveyance guide surface 423*b* of the flipper 421, and an outer conveyance guide 45. The sheet S on which the reversal operation is performed passes in the conveyance area PC.

Next, an operation by the two-sided discharge device 105 will be described below with reference to FIG. 5 and FIGS. 6A through 6C.

Figure 5:
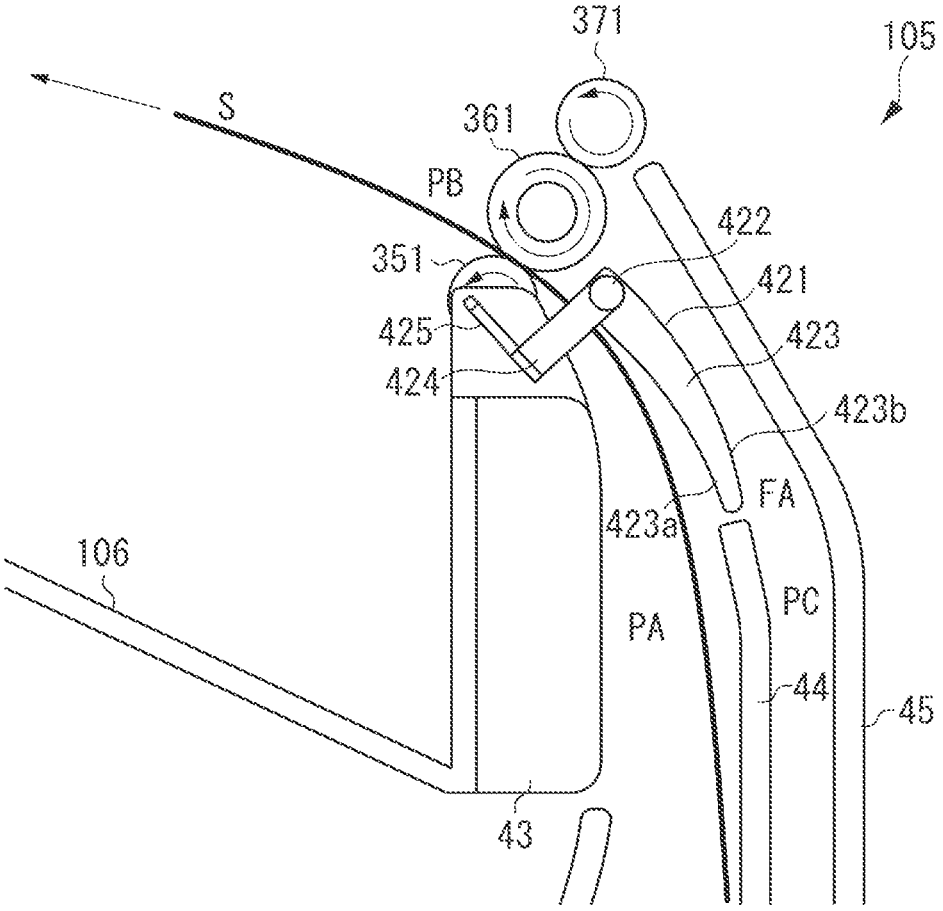
FIG. 5 is a schematic sectional view illustrating a discharge operation by the two-sided discharge device during one-sided printing according to the first exemplary embodiment.

FIG. 5 is a schematic sectional view illustrating the discharge operation by the two-sided discharge device 105 when one-sided printing is to be performed. As illustrated in FIG. 5, during one-sided printing, the discharge driving roller 361 rotates clockwise, and the discharge driven roller 351 and the reversal driven roller 371 are driven to rotate counterclockwise. The flipper 421 operates in conjunction with the clockwise rotation of the discharge driving roller 361 and is locked in a position FA. The backward movement prevention portion 425 of the flipper 421 locked in the position FA does not protrude into the conveyance areas PA, PB, or PC of the two-sided discharge device 105, and stays in a retracted position. In other words, the backward movement prevention portion 425 is located in an allowing position where discharge of the sheet S by the discharge driving roller 361 and the discharge driven roller 351 is allowed. The sheet S passes the conveyance area PA, and is conveyed toward the triple rollers by the fixing conveyance roller pair. Then, the sheet S is guided by the conveyance guide surface 423*a* of the flipper 421 to the nip area formed by the discharge driving roller 361 and the discharge driven roller 351, and is discharged onto the discharge tray 106 by the discharge driving roller 361 and the discharge driven roller 351.

Figure 6A:
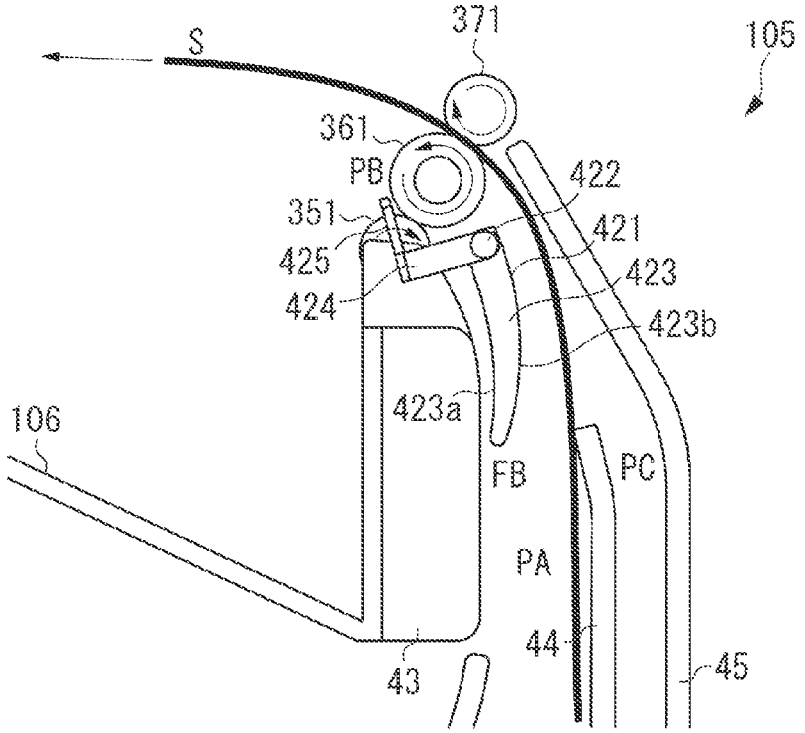
FIG. 6A is a schematic sectional view illustrating a first stage of a reversal operation by the two-sided discharge device during two-sided printing according to the first exemplary embodiment.
Figure 6B:
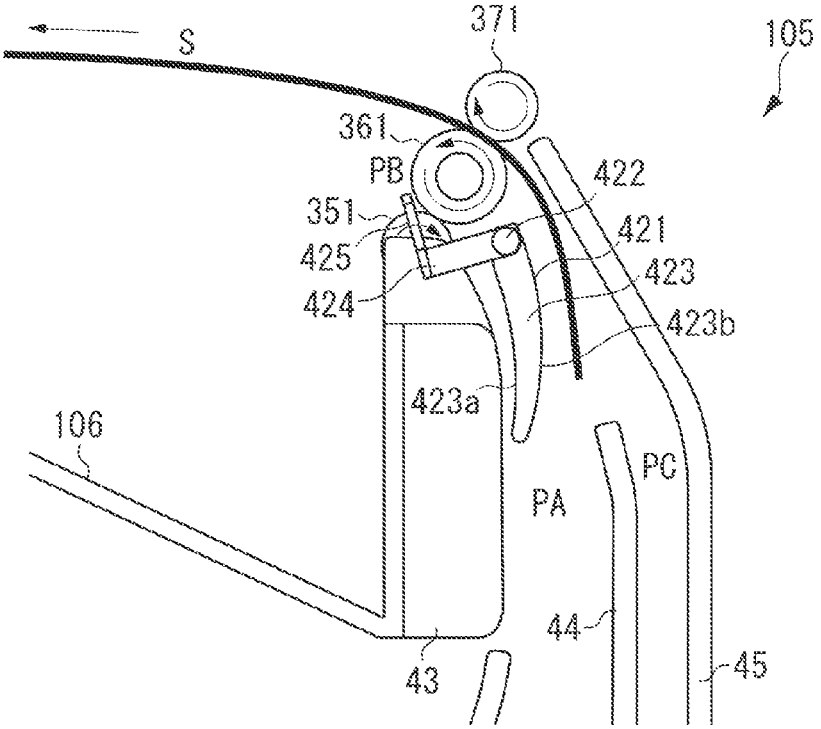
FIG. 6B is a schematic sectional view illustrating a second stage of the reversal operation by the two-sided discharge device during two-sided printing according to the first exemplary embodiment.
Figure 6C:
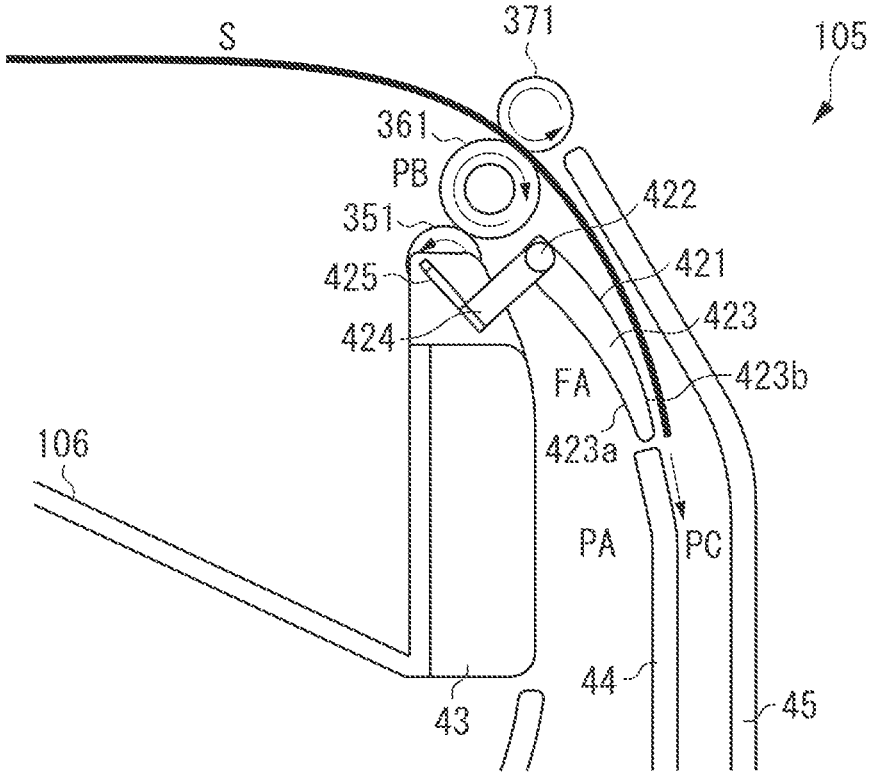
FIG. 6C is a schematic sectional view illustrating a third stage of the reversal operation by the two-sided discharge device during two-sided printing according to the first exemplary embodiment.

Next, FIGS. 6A through 6C are schematic sectional views illustrating the reversal operation by the two-sided discharge device 105 when two-sided printing is to be performed. As illustrated in FIG. 6A, during two-sided printing, the discharge driving roller 361 rotates counterclockwise, and the discharge driven roller 351 and the reversal driven roller 371 are driven to rotate clockwise. The flipper 421 rotates in conjunction with the counterclockwise rotation of the discharge driving roller 361, and is locked in a position FB. At this time, the backward movement prevention portion 425 of the flipper 421 is locked in a position (regulation position) where the backward movement prevention portion 425 protrudes into the conveyance area PB, and blocks the conveyance area PB side of the nip area formed by the discharge driving roller 361 and the discharge driven roller 351. The regulation position of the backward movement prevention portion 425 overlaps a path through which the sheet S discharged by the discharge driving roller 361 and the discharge driven roller 351 passes. The backward movement prevention portion 425 blocks the area on the downstream side of the nip portion between the discharge driving roller 361 and the discharge driven roller 351 (the straight line connecting their respective rotation centers), thereby preventing the sheet S from moving backward (from entering the nip portion between the discharge driving roller 361 and the discharge driven roller 351). In other words, the regulation position of the backward movement prevention portion 425 is a position for blocking the nip portion between the discharge driving roller 361 and the discharge driven roller 351 as viewed from the width direction of the sheet S orthogonal to the discharging direction.

That is, the backward movement prevention portion 425 is provided so as to be movable between the retracted position and the regulation position, and is moved by the solenoid (moving portion) 90.

When a print command is issued by the user, a first sheet S is conveyed by the fixing conveyance roller pair toward the triple rollers after the feeding and printing. Then, the first sheet S is guided to the nip portion between the discharge driving roller 361 and the reversal driven roller 371 by the conveyance guide surface 423*b*. Then, as illustrated in FIG. 6B, when the first sheet S has been conveyed to a position where the trailing edge of the first sheet S is located on the downstream side of the end portion of the middle conveyance guide 44, the rotation of the discharge driving roller 361 is switched to reverse rotation by the solenoid 90. Then, as illustrated in FIG. 6C, the position of the flipper 421 is also switched to FA in conjunction with the switching of the rotation. The first sheet S is conveyed in the reverse direction by the discharge driving roller 361 and the reversal driven roller 371, and is conveyed toward the conveyance area PC for reversal which consists of the middle conveyance guide 44 and the outer conveyance guide 45. Then, the first sheet S passes through the two-sided printing conveyance path, the image forming unit 101, and the fixing device 103 and then is discharged again by the discharge driving roller 361 and the discharge driven roller 351 as illustrated in FIG. 5.

In the series of operations described above, the print command from the user requires two-sided printing on a single sheet. Actually, however, there are many cases where the print command requires two-sided printing on a plurality of sheets. In the case of two-sided printing on a plurality of sheets, for the first sheet S, after printing is performed on a front side, the first sheet S is reversely conveyed to the two-side printing conveyance path, fed again and undergoes printing on a back side, and then discharged. During the above operation, a second sheet S is fed by the feeding device 102, and after printing is performed on a front side, the second sheet S takes the same path as the first sheet S. However, the first sheet S and the second sheet S are fed and conveyed with a timing based on a sensor signal so that they do not overlap each other in the conveyance path. Thus, conveying the first sheet S and the second sheet S with an appropriate timing enables continuous two-sided printing to be performed at a high speed.

Figure 7:
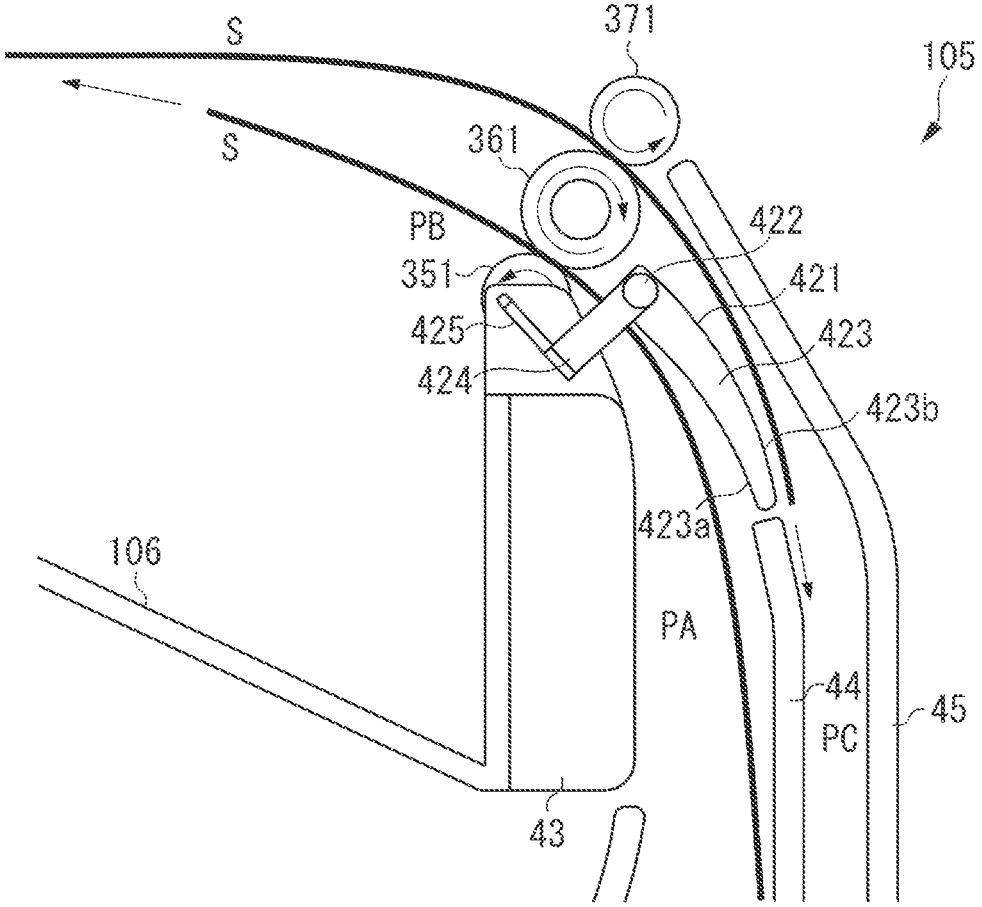
FIG. 7 is a schematic sectional view illustrating the reversal operation and the discharge operation by the two-sided discharge device during continuous two-sided printing according to the first exemplary embodiment.

FIG. 7 is a schematic sectional view illustrating the reversal operation and the discharge operation by the two-sided discharge device 105 during continuous two-sided printing. As illustrated in FIG. 7, when the discharge driving roller 361 rotates clockwise, the discharge driving roller 361 and the discharge driven roller 351 rotate in a direction for discharging the sheet S, and the discharge driving roller 361 and the reversal driven roller 371 rotate in a direction for reversing the sheet S. The above-described triple roller configuration can simultaneously perform the operation of discharging the sheet S which has undergone printing and the operation of reversing the sheet S to be reversed, thereby achieving an increase in the speed of the operation to continuously perform printing on both sides.

Figure 8:
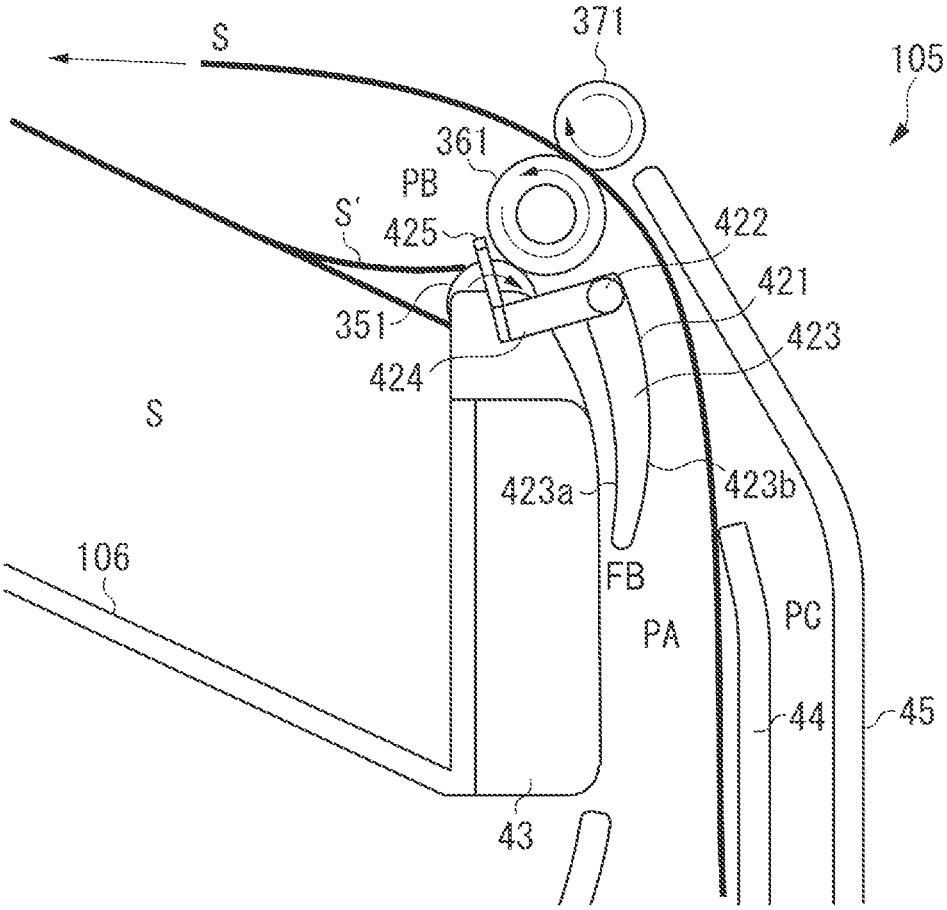
FIG. 8 is a schematic sectional view illustrating the reversal operation by the two-sided discharge device in a state where there exists a sheet discharged and stacked on a discharge tray during two-sided printing according to the first exemplary embodiment.

FIG. 8 is a schematic sectional view illustrating the reversal operation by the two-sided discharge device 105 in a state where there exists a discharged and stacked sheet on the discharge tray 106 during two-sided printing. As illustrated in FIG. 8, when continuous printing is performed, sheets S on which printing has been completed are stacked and accumulated on the discharge tray 106. At this time, depending on the printing condition, the peripheral environment, and the state of the sheet S itself, there may exist a sheet S' that cannot be completely stacked on the discharge tray 106, with the end portion in contact with the discharge driven roller 351. When the reversal operation is to be performed by the two-sided discharge device 105 in this state, the discharge driving roller 361 rotates counterclockwise, causing the sheet S' to be conveyed to the upstream side in the conveyance direction due to the frictional force generated at the position where the sheet S' is in contact with the discharge driven roller 351.

In the first exemplary embodiment, the position of the flipper 421 is switched from FA to FB at the same time as the discharge driving roller 361 rotates counterclockwise. With this, the backward movement prevention portion 425 moves from the retracted position to the regulation position, and protrudes into the conveyance area PB. As a result, the backward movement prevention portion 425 stops the sheet S' before the sheet S' is conveyed to the upstream side and enters the nip area formed by the discharge driving roller 361 and the discharge driven roller 351, thereby preventing the sheet S' from moving backward. That is, the backward movement prevention portion 425 located at the regulation portion blocks the conveyance area PB side of the nip area formed by the discharge driving roller 361 and the discharge driven roller 351 to thereby regulate the position of the sheet S' on the discharge tray 106. The backward movement prevention portion 425 blocks the conveyance area PB side of the nip area formed by the discharge driving roller 361 and the discharge driven roller 351, so that the sheet S' on the discharge tray 106 cannot be moved to the nip portion between the discharge driving roller 361 and the discharge driven roller 351.

The closer the contact position of the sheet S' and the discharge driven roller 351 to the nip area formed by the discharge driving roller 361 and the discharge driven roller 351, the higher the possibility of occurrence of the backward movement of the sheet S'. Further, the faster the timing and operation of switching the flipper 421 from the position FA to the position FB, the higher the possibility of prevention of the backward movement of the sheet S'.

In the first exemplary embodiment, the operation of switching the position of the flipper 421 is in conjunction with the rotational direction of the discharge driving roller 361, so that the operation of switching the position of the flipper 421 is performed simultaneously with the conveyance of the sheet S' to the upstream side due to the reverse rotation of the discharge driving roller 361. As a result, the timing of when the sheet S' is conveyed to the upstream side and the timing of when the backward movement prevention portion 425 changes the position to the position for preventing the backward movement are substantially simultaneous with each other. Further, when the position of the flipper 421 is FA, the backward movement prevention portion 425 is on standby near the nip area formed by the discharge driving roller 361 and the discharge driven roller 351, so that the time required to perform the operation of switching to the position FB is short. This can produce the effect of increasing the area where the sheet S' can be prevented from moving backward.

As described above, according to the first exemplary embodiment, during the reversal operation by the two-sided discharge device 105, the position of the flipper 421 is switched at the same time as the rotational direction of the triple rollers is reversed, causing the backward movement prevention portion 425 of the flipper 421 to protrude into the conveyance area PB. As a result, even if the stacked sheet S is in contact with the discharge driven roller 351, it is possible to prevent a conveyance failure from occurring due to the backward movement of the sheet S. In the first exemplary embodiment, the configuration has been described in which the flipper 421 and the backward movement prevention portion 425 are integrally provided. However, the present invention is not limited thereto. The backward movement prevention portion 425 and the flipper 421 may be separately provided. For example, they are connected to each other via a link member so that the backward movement prevention portion 425 can operate in conjunction with the flipper 421.

Further, in the first exemplary embodiment, the configuration has been described in which the switching of the rotational direction of the discharge driving roller 361 and the switching of the position of the flipper 421 are performed by the common solenoid 90. However, the present invention is not limited thereto. The above switching operations may be performed by different solenoids. That is, a solenoid for moving the flipper may be separately provided, and be operated with the timing of switching the rotational direction.

Furthermore, in the first exemplary embodiment, the configuration has been described in which the timing of when the positions of the flipper 421 and the backward movement prevention portion 425 are switched is the same as the timing of when the rotational direction of the discharge driving roller 361 is switched. However, the present invention is not limited thereto. It is desirable for the backward movement prevention portion 425 to be placed at the regulation position a little earlier than the timing of when the rotational direction of the discharge driving roller 361 is switched. However, it is also possible for the backward movement prevention position 425 to be placed at the regulation portion a little later than the timing of when the rotational direction of the discharge driving roller 361 is switched.

A second exemplary embodiment of the present invention will be described below. In the secondary exemplary embodiment, a basic configuration of the image forming apparatus 100 is similar to that of the first exemplary embodiment, and therefore the components having functions and configurations similar or corresponding to those of the first exemplary embodiment are denoted by the same reference numerals, and a detailed description thereof will be omitted.

First, a two-sided discharge device 107 included in the image forming apparatus 100 according to the second exemplary embodiment will be described with reference to FIG. 9.

Figure 9:
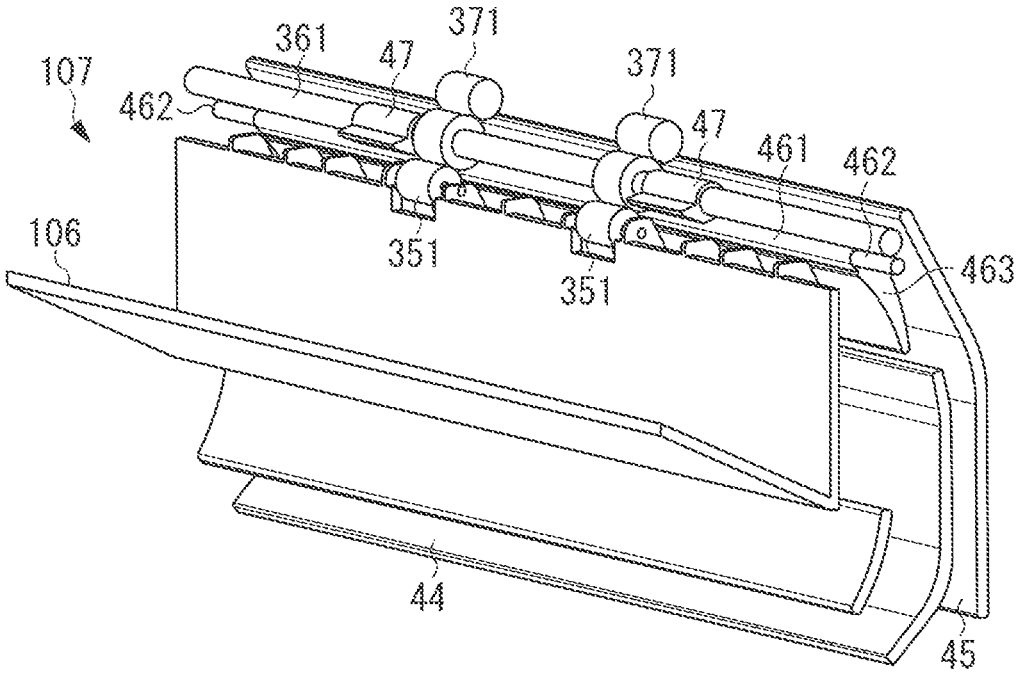
FIG. 9 is a schematic perspective view of a two-sided discharge device according to a second exemplary embodiment.

FIG. 9 is a schematic perspective view of the two-sided discharge device 107. As illustrated in FIG. 9, the two-sided discharge device 107 includes triple rollers similar to those of the first exemplary embodiment, a flipper 461, and a backward movement prevention member 47. The configuration in which the flipper 461 changes its position in conjunction with the rotational direction of the triple rollers is similar to that of the first exemplary embodiment. The flipper 461 is rotatably supported by rotation centers 462. The backward movement prevention member 47 is supported coaxially with the discharge driving roller 361 and so as to be rotatable. As illustrated in FIG. 3B according to the first exemplary embodiment, the backward movement prevention member 47 is arranged symmetrically with respect to the center M of the conveyance area L of the sheet S and within the conveyance area L. The backward movement prevention member 47 is fit with the shaft of the discharge driving roller 361. When the discharge driving roller 361 rotates, the backward movement prevention member 47 also rotates in the same direction due to friction against the shaft of the discharge driving roller 361. When a part of the backward movement prevention member 47 reaches a position that is in contact with a peripheral member, the position of the backward movement prevention member 47 is determined and locked. That is, the backward movement prevention member 47 has two lock positions corresponding to the normal rotation and reverse rotation of the discharge driving roller 361.

Next, an operation by the two-sided discharge device 107 will be described with reference to FIGS. 10A and 10B.

Figure 10A:
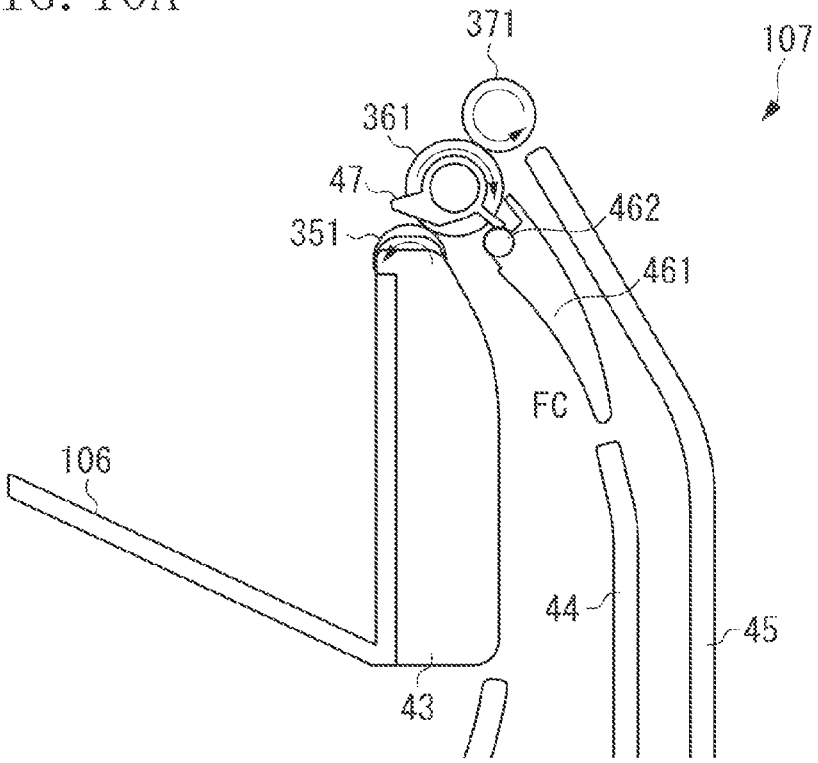
FIG. 10A is a schematic sectional view illustrating a position of the two-sided discharge device according to the second exemplary embodiment during discharge operation.

FIG. 10A is a schematic sectional view illustrating a configuration of the two-sided discharge device 107 when performing discharge operation. As illustrated in FIG. 10A, when performing the discharge operation, the discharge driving roller 361 rotates clockwise, and the discharge driven roller 351 and the reversal driven roller 371 are driven to rotate counterclockwise. In conjunction with the clockwise rotation of the discharge driving roller 361, the flipper 461 is locked in a position FC. The backward movement prevention member 47 rotates clockwise due to sliding contact with the shaft of the discharge driving roller 361, and comes into contact with a part of the flipper 461, whereby the position thereof is determined. At this time, the backward movement prevention member 47 is locked in a position (retracted position) where the backward movement prevention member 47 does not prevent the sheet S from being conveyed for one-sided printing or two-sided printing.

Figure 10B:
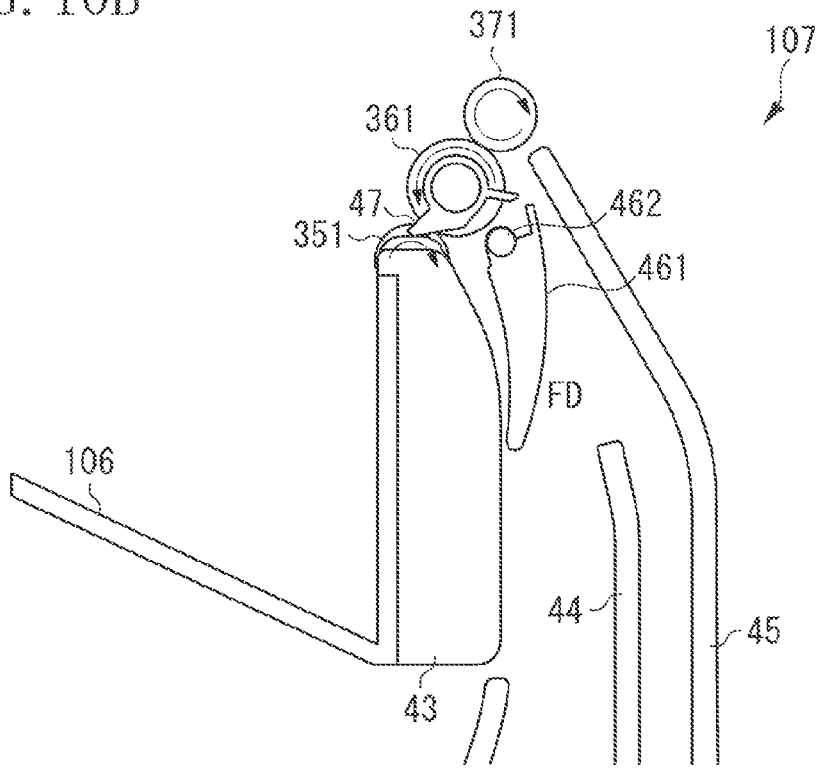
FIG. 10B is a schematic sectional view illustrating a position of the two-sided discharge device according to the second exemplary embodiment during reversal operation.

FIG. 10B is a schematic sectional view illustrating a configuration of the two-sided discharge device 107 when performing reversal operation. As illustrated in FIG. 10B, when performing the reversal operation, the discharge driving roller 361 rotates counterclockwise, and the discharge driven roller 351 and the reversal driven roller 371 are driven to rotate clockwise. In conjunction with the counterclockwise rotation of the discharge driving roller 361, the flipper 461 is locked in a position FD. The backward movement prevention member 47 rotates counterclockwise due to sliding contact with the shaft of the discharge driving roller 361, and comes into contact with a part of the inner conveyance guide 43, whereby its position is determined. At this time, the backward movement prevention member 47 blocks the nip area formed by the discharge driving roller 361 and the discharge driven roller 351, and is locked at a position (regulation position) where the sheet S can be prevented from moving backward from the conveyance area PB. This configuration prevents the sheet S', which cannot be completely stacked on the discharge tray 106 and be in contact with the discharge driven roller 351, from moving backward toward the nip area formed by the discharge driving roller 361 and the discharge driven roller 351.

As described above, the configuration according to the second exemplary embodiment can also prevent the sheet S from moving backward in the area near the nip potion between the discharge roller pair, so that an effect similar to that of the first exemplary embodiment can be achieved without increasing the size of the apparatus.

According to the exemplary embodiments of the present invention, the regulation portion is placed in the regulation position while the driving roller is making reverse rotation. Thus, even if the driving (first) roller makes reverse rotation in a state where a sheet on the stacking portion exists near the first roller and the second roller, the regulation portion can block the area on the downstream side of the nip portion between the first and second rollers. As a result, when the reversal operation is performed to form images on both sides of the sheet, it is possible to prevent a conveyance failure from occurring due to the backward movement of the sheet into the main body of the apparatus (for example, catching of the sheet at the step portion in the conveyance path, or interference of the sheet with the subsequent sheet during continuous printing).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-205133 filed Sep. 30, 2013, which is hereby incorporated by reference herein in its entirety.

What is claimed is:

1. An image forming apparatus comprising:

an image forming unit configured to form an image on a sheet;

a stacking portion on which the sheet, having the image formed on the sheet by the image forming unit, is to be stacked;

a first roller rotatable in a forward rotation direction and in a reverse rotation direction;

a second roller configured to discharge the sheet to the stacking portion by rotating with the first roller which is rotating in the forward rotation direction;

a third roller configured to convey a sheet, having an image formed on a first side of the sheet by the image forming unit, to the image forming unit again to form an image on a second side of the sheet, opposite to the first side of the sheet, by rotating with the first roller which is rotating in the forward rotation direction after rotating in the reverse rotation direction;

a regulation portion configured to be movable between a regulation position, where conveying of the sheet stacked on the stacking portion in a direction opposite to a discharge direction by the second roller is regulated, and an allowing position, where discharging of the sheet by the first roller and the second roller is allowed;

a movement unit configured to move the regulation portion between the regulation position and the allowing position; and a switching portion configured to be movable between a first position where the sheet having the image formed on the sheet by the image forming unit is guided by the switching portion to a conveying portion formed by the first roller and the second roller and a second position where the sheet having the image formed on the sheet by the image forming unit is guided by the switching portion to a conveying portion formed by the first roller and the third roller, wherein the switching portion and the regulation portion are configured to rotate coaxially, wherein the movement unit positions the regulation portion at the allowing position in a state where the first roller is rotating in the forward rotation direction, and positions the regulation portion at the regulation position in a state where the first roller is rotating in the reverse rotation direction, wherein the regulation portion, positioned at the regulation position, blocks an exit of the conveying portion formed by the first roller and the second roller, and wherein, when the regulation portion is positioned at the regulation position, the second roller is positioned at a position that is the same position at which the second roller is positioned when the regulation portion is positioned at the allowing position.

2. The image forming apparatus according to claim 1, wherein the regulation position of the regulation portion is a position which overlaps a path through which the sheet discharged by the first roller and the second roller passes.

3. The image forming apparatus according to claim 1, wherein the switching portion and the regulation portion are provided integrally.

4. The image forming apparatus according to claim 1, wherein the regulation portion is coupled to the switching portion by a connection portion, and wherein the regulation portion and the connection portion form an L shaped member.

5. The image forming apparatus according to claim 1, further comprising a drive unit configured to rotate the first roller, wherein the second roller rotates following the first roller, and the third roller rotates following the first roller.

6. The image forming apparatus according to claim 1, further comprising a control unit configured to switch a rotational direction of the first roller between the forward rotation direction and the reverse rotation direction, wherein the movement unit moves the regulation portion in conjunction with an operation of switching the rotational direction of the first roller by the control unit.

7. The image forming apparatus according to claim 6, wherein the control unit controls a solenoid to switch a drive train for transmitting a drive force from a drive source to the first roller.

8. The image forming apparatus according to claim 1, wherein the first roller and the second roller form a nip portion and the first roller and the third roller form a nip portion.

9. The image forming apparatus according to claim 1, wherein the regulation portion regulates entering of the sheet stacked on the stacking portion into a nip portion between the first roller and the second roller.

10. The image forming apparatus according to claim 1, wherein the regulation portion is rotatable between the regulation position and the allowing position.

11. The image forming apparatus according to claim 1, wherein the regulation portion moves in connection with a moving of the switching portion.

12. The image forming apparatus according to claim 1, wherein the regulation portion prevents the sheet stacked on the stacking portion from moving in a direction that is backward of the forward direction of the forward rotation direction.

13. An image forming apparatus comprising:

an image forming unit configured to form an image on a sheet;

a stacking portion on which the sheet, having the image formed on the sheet by the image forming unit, is to be stacked;

a conveying unit including:

a first roller configured to rotate in a forward rotation direction and in a reverse rotation direction, a second roller configured to form a first nip portion with the first roller, and configured to be rotated by a rotation of the first roller, wherein the first nip portion conveys and discharges the sheet having the image formed thereon to the stacking portion while the first roller is rotating in the forward rotation direction, and a third roller configured to form a second nip portion with the first roller and configured to be rotated by the rotation of the first roller, wherein the second nip portion conveys the sheet having the image formed on one side surface of the sheet to the image forming unit to form an image on the other side surface of the sheet while the first roller is rotating in the forward rotation direction after rotating in the reverse rotation direction;

a guide portion configured to be movable between a first position in which the guide portion guides the sheet having the image formed thereon by the image forming unit toward the first nip portion and a second position in which the guide portion guides the sheet having the image formed thereon by the image forming unit toward the second nip portion; and a blocking portion configured to be movable between a blocking position in which the blocking portion blocks an exit region where the sheet comes out of the first nip portion and a retracting position in which the blocking portion retracts from the blocking position, wherein the blocking portion and the guide portion are configured to rotate coaxially, wherein the blocking portion is positioned at the blocking position while the first roller is rotating in the reverse rotation direction, and the blocking portion is positioned at the retracting position while the first roller is rotating in the forward rotation direction, and wherein the second roller is positioned at the same position, regardless of a position of the blocking portion.

14. The image forming apparatus according to claim 13, wherein the guide portion and the blocking portion are provided integrally.

15. The image forming apparatus according to claim 13, wherein the blocking portion blocks a path through which the sheet discharged by the first nip portion passes.

16. The image forming apparatus according to claim 14, wherein the guide portion includes a connection portion by which the blocking portion is coupled to the guide portion, and wherein the connection portion is provided on a longitudinal end portion of the guide portion outside a conveyance area, in a sheet width direction orthogonal to a sheet conveyance direction, in which the maximum size sheet which can be conveyed by the conveying unit passes.

* * * * *